US005950927A

United States Patent [19]

Elliott et al.

[11] Patent Number: 5,950,927

[45] Date of Patent: Sep. 14, 1999

[54] WOBBLING SPRINKLER HEAD

[75] Inventors: Frederick T. Elliott; William J. McFadden, both of Clermont, Fla.

[73] Assignee: Senninger Irrigation, Inc., Orlando, Fla.

[21] Appl. No.: 08/954,238

[22] Filed: Oct. 20, 1997

[51] Int. Cl.[6] ..... B05B 3/08; B05B 1/34

[52] U.S. Cl. ..... 239/222.21; 239/233; 239/236; 239/383

[58] Field of Search ..... 239/222.21, 222.17, 239/222.11, 222, 229, 233, 236, 243, 383, 382, 381, 380, 498

[56] References Cited

U.S. PATENT DOCUMENTS

| | | | |
|---|---|---|---|
| 3,009,648 | 11/1961 | Hait | 239/201 |
| 3,034,728 | 5/1962 | Hruby, Jr. | 239/206 |
| 3,091,400 | 5/1963 | Aubert | 239/261 |
| 4,356,972 | 11/1982 | Vikre | 239/177 |
| 4,487,368 | 12/1984 | Clearman | 239/229 |
| 4,773,594 | 9/1988 | Clearman | 239/229 |
| 5,381,960 | 1/1995 | Sullivan et al. | 239/222.21 |
| 5,439,174 | 8/1995 | Sweet | 239/222.17 |
| 5,588,595 | 12/1996 | Sweet et al. | 239/222.17 |
| 5,671,885 | 9/1997 | Davisson | 239/222.17 |

*Primary Examiner*—Andres Kashnikow
*Assistant Examiner*—Sean O'Hanlon
*Attorney, Agent, or Firm*—William M. Hobby, III

[57] ABSTRACT

A wobbling sprinkler head is provided, especially for use in irrigation systems such as self-propelled mechanically moving irrigation systems, in which the wobbling sprinkler head faces downward from the water supply conduit. The sprinkler head has a body having a water inlet as well as an attachment for connection to the water supply and a nozzle for directing a stream of water from the sprinkler body. The sprinkler head has one or more arms extending from the body around a water deflecting head. The water deflecting head is movably attached to the sprinkler head body and has a water deflecting surface positioned to deflect water from the nozzle and move the water defecting head. The bottom of the water deflecting surface has a protruding member extending therefrom, for interacting with a second protruding member extending from the arms of the sprinkler head body. The protruding members can have magnets of opposing polarity mounted therein. Thus, the water deflecting head has a wobbling motion while distributing water from the rotating sprinkler head to thereby vary the sprinkling action.

18 Claims, 3 Drawing Sheets

WOBBLING SPRINKLER HEAD

BACKGROUND OF THE INVENTION

The present invention relates to a wobbling sprinkler head and especially to a wobbling sprinkler head for use in irrigation systems and the like.

It has become common practice to use center pivot irrigation systems in the irrigation of large fields and these typically comprise a long water conduit which is pivotally connected at one end to a source of water under pressure. The conduit arm is carried in an elevated position by a plurality of spaced wheels or wheel towers which are powered by hydraulic, pneumatic, or electric motors to rotatably sweep the central conduit over a circular pattern in a field. The center conduit includes a plurality of water sprinkling heads spaced over its length for distributing a spray of water on the circular field area as the center pivot irrigation conduit passes thereby. Center pivot irrigation systems have been successful for uniform distribution of water over a field crop and initially were operated at reasonably high water pressures. Current systems typically work with a somewhat lower water pressure and require that sprinkler heads distribute water evenly as the center pivot irrigation conduit moves through a field. A typical patent for a center pivot irrigation system can be seen in the Vikre patent, U.S. Pat. No. 4,356,972, which mounts the sprinkler heads on top of the central irrigation center pivot conduit. The sprinkler head uses a deflector head for deflecting the water with a grooved deflector pad. Other self-propelled mechanically moving irrigation machines can irrigate in a different manner, such as moving laterally in a straight line through a field.

There have been a number of wobbling sprinkler heads used in the past in which the water distribution head of the sprinkler, instead of being rotated in a smooth rotation or instead of following one of the other sprinkler patterns, has a water distribution head which wobbles in a rotating fashion to provide a more even distribution of water. In the Clearman patents, U.S. Pat. No. 4,487,368 and U.S. Pat. No. 4,773,594, a control pattern wobbling sprinkler is provided in which a rotating sprinkler head has a wobbling water distribution head mounted on the end thereof which has a plurality of vanes formed in the wobbling portion of the head to force a wobbling motion which results from the loose connection between the distribution head and the supporting arm of the sprinkler head. In the sprinkler of these two patents, a base is provided for ground support and a rotating sprinkler head has the end of the rotating arm bent at an angle so that the loosely attached wobbling head tilts groundward when not being used. Upon initiation of water under pressure to the head, the head is already in a cocked position and forces a rotating action which causes a wobbling rotation of the water head portion. In the J. M. Hait patent, U.S. Pat. No. 3,009,648, an irrigation system is provided in which the sprinkler head has a rotating stream of water issuing therefrom but allows a deflection head to move back and forth. In J. O. Hruby, Jr., U.S. Pat. No. 3,034,728, a lawn sprinkler is shown which has a centrally disposed and vertically extending stem which is made to rotate by the action of the water passing through the sprinkler. The stem is loosely mounted and has an uneven deflecting portion to produce a rotating action of the spray. In the M. S. Aubert patent, U.S. Pat. No. 3,091,400, a dishwashing machine has a rotary wobbling spring head which is driven by the water momentum to wobble the head in a dishwasher.

In Applicant's U.S. Pat. No. 5,381,960, a wobbling irrigation sprinkler head includes a magnet for the initial tilt in a wobbling irrigation sprinkler head for use on a self-propelled mechanical moving irrigation system, such as a center pivot field irrigation system, having the wobbling sprinkler head facing downward from the water supply conduit. This sprinkler head produces a wobbling motion as a result of the nozzle directing water onto a deflector pad having a predetermined shape with water deflecting grooves which rotates and wobbles the water deflecting head. A magnet is mounted in the sprinkler head base to attract a ferric metal washer mounted in the wobbling deflecting head to tilt the wobbling water deflector head relative to the base to cock the deflector head to initiate the wobbling in the deflector head.

The present invention is a wobbling sprinkler head similar to this patent but produces a wobbling motion by a different wobble mechanism mounted between the sprinkler body having a protruding member, such as a cone, and a protruding member extending from the water deflection head, which may also be a cone shape. The interaction of protruding members or the force of opposing magnets if desired forces the deflection head to start wobbling as the deflection head rotates. The water deflection head is prevented from the center position to thereby always keep the water deflecting surface at an angle to the stream of water being emitted from the nozzle. Once the deflection head starts rotating, the protruding members do not touch since the circle of rotation is outside the stationary protruding members or magnetic fields.

SUMMARY OF THE INVENTION

A wobbling sprinkler head is provided, especially for use in irrigation systems such as self-propelled mechanically moving irrigation systems, in which the wobbling sprinkler head faces downward from the water supply conduit. The sprinkler head has a body having a water inlet as well as an attachment for connection to the water supply and a nozzle for directing a stream of water from the sprinkler body. The sprinkler head has one or more arms extending from the body around a water deflecting head. The water deflecting head is movably attached to the sprinkler head body and has a water deflecting surface positioned to deflect water directed thereagainst from the nozzle. The water deflecting surface has a predetermined shape including shaped grooves which cause the water deflecting head to move responsive to the water being directed thereagainst. The bottom of the water deflecting surface has a protruding cone-shape member extending therefrom, for interacting with a second protruding member extending from the arms of the sprinkler head body. The second member can also be a cone so that the water deflecting head has the one protruding cone riding around the second protruding cone as the water deflecting head rotates responsive to water directed thereagainst from the nozzle. These two members can also contain opposing magnets so as to keep the deflecting surface off center. Thus, the water deflecting head has a wobbling motion while distributing water from the rotating sprinkler head to thereby vary the sprinkling action.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
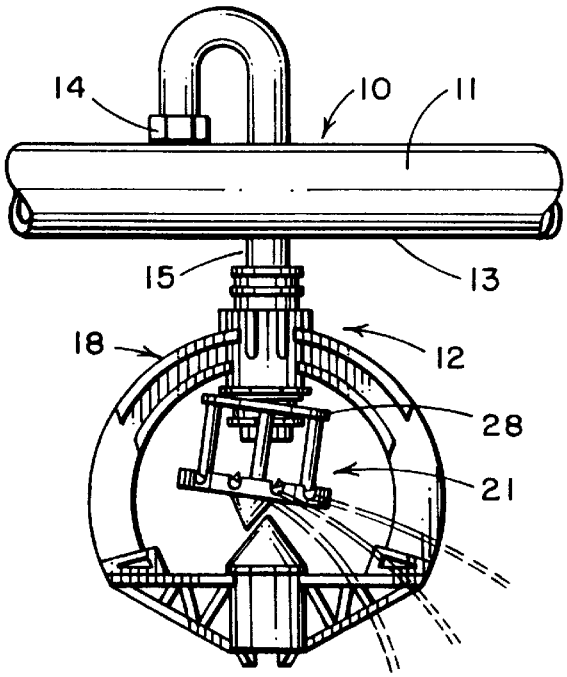
FIG. 1 is a side elevation of a portion of a central pivot irrigation system having the present sprinkler head attached thereto.
Figure 2:
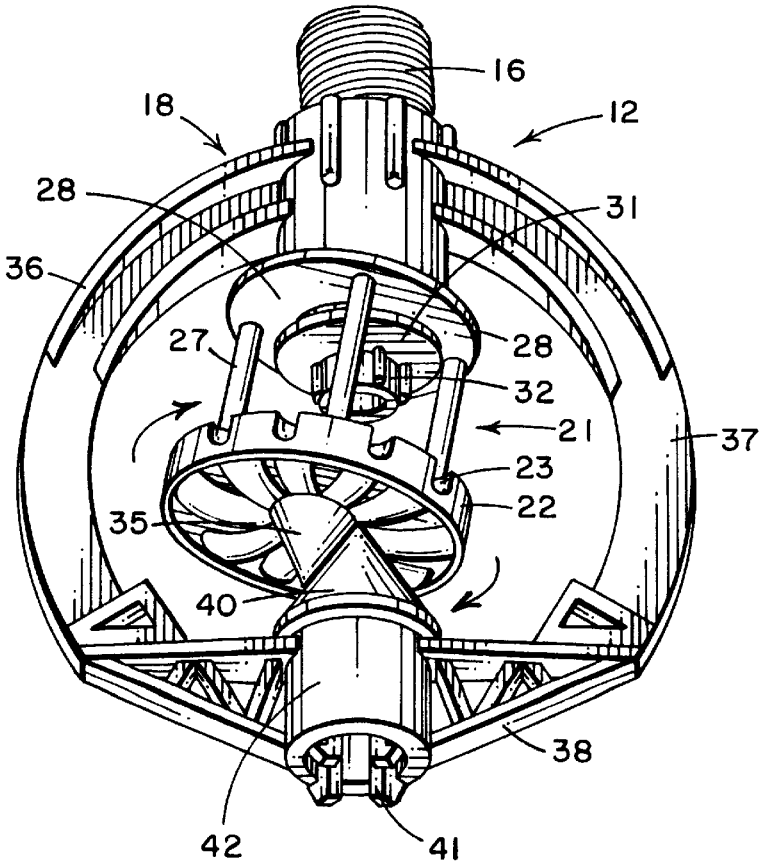
FIG. 2 is a perspective view of a sprinkler head in accordance with the present invention.
Figure 3:
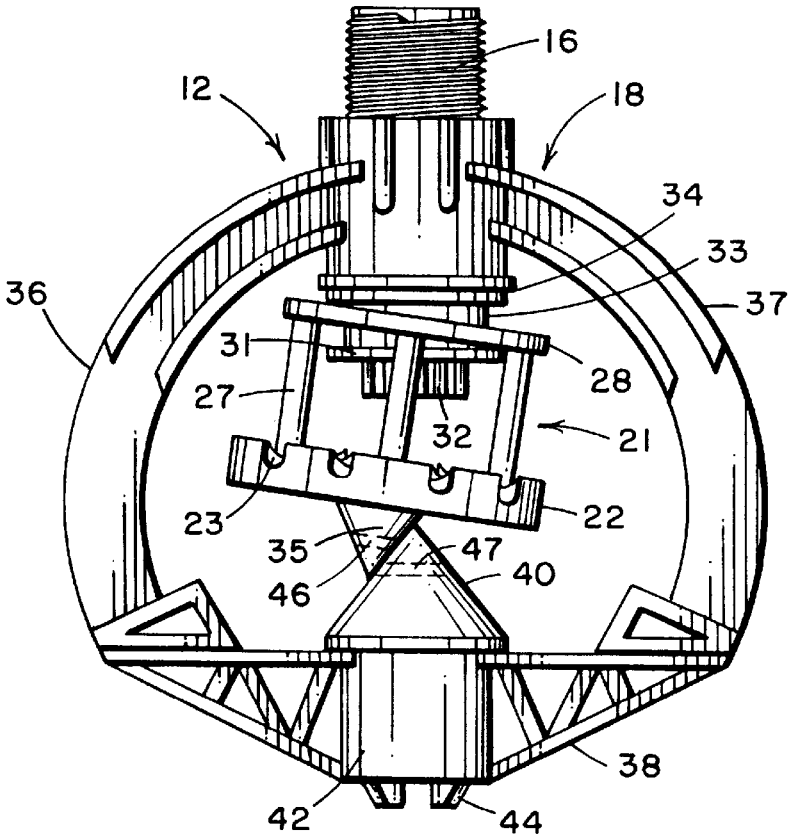
FIG. 3 is a side elevation of the sprinkler head of FIG. 2.
Figure 4:
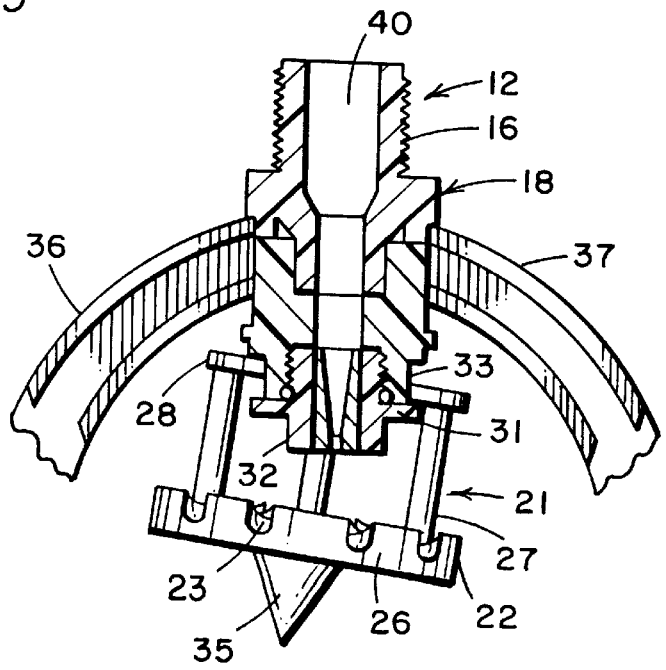
FIG. 4 is a sectional view taken through a portion of the sprinkler head of FIGS. 1–3.

Referring to FIG. 1 of the drawings, a portion of a self-propelled mechanical moving irrigation system, such as a center pivot irrigation system 10, has a central irrigation conduit or water supply pipe 11 which is rotated on wheels in a field, such as in a circular pattern for irrigating the field. The central water supply conduit 11 has a plurality of sprinkler heads 12 attached thereto in a spaced relationship to each other. In this case, each sprinkler head pipe 15 extends from the top 13 of the pipe 11 and includes a pipe coupling 14 attached thereto. The pipe 15 has a U-shaped bend and has the sprinkler head 12 attached thereto.

The sprinkler head 12, as seen in FIGS. 1–4, includes a threaded fitting coupling 16 forming part of the sprinkler head body 18. The body 18 has an attached water deflecting head 21 having a water deflecting pad 22 attached thereto. The deflection pad 22 has a plurality of angled grooves 23 formed therein for deflecting water being impinged thereupon in a predetermined pattern with all of the grooves on the deflection pad open along the circular edge portion 26 of the deflection pad 22. The deflection pad is held by a plurality of posts 27. In this case, three posts have been used which are in turn all attached to a post support base portion 28. The post base portion 28 is shaped generally like a washer and may be made of a polymer and has an opening in the center thereof.

The sprinkler head body 18 has an annular flange 31 which may be a part of the nozzle 32 which is threadedly attached with the threads 33 to the body 18. Thus, the water deflection head 21 is supported on the flange 31 around the cylindrical portion 33 and is loosely held from the top by a flange 34. This support of the water deflecting head 21 allows it to rotate on the shaft portion 33 supported by the flange 31 in a loose manner so that when the water exiting the nozzle 32 impinges on the deflection pad 22, it not only deflects and rotates the water deflection head 21 but allows it to freely wobble. Deflection pad 22 has a protruding wobble generating member 35 in the shape of a cone protruding form the bottom of the pad 22. The protruding member 35 can also, of course, be other shapes as desired including a truncated cone or even a cylindrical shape and can also contain magnets with opposite facing poles without departing from the spirit and scope of the invention.

The sprinkler head body 18 has a pair of arcuate arms 36 and 37 extending from each side thereof and being attached to a truss 38 extending between the ends of the arms 36 and 37. The truss 38 in turn supports a fixed protruding wobble generating member 40 which may also be a cone or a truncated cone or magnets as desired which engages with the wobble generating member 35 as the sprinkler head 21 rotates to always maintain the member 35 off-center. Magnets with oppositely facing polarity can also be included to repulse the protrusion member. This in turn always maintains the water deflecting head 21 at an angular position, so that as the water which is entering the inlet 40 of the sprinkler body 18 and is being emitted from the nozzle 32 onto the grooved water deflection pad 22, forces the deflection pad 22 and the water deflection head 21 to rotate off-center. This will force the entire sprinkler head to wobble as it rotates in a continuously rotating and wobbling motion which continuously changes the break pattern exiting the grooves from the deflection head. The water continues to impinge on the channels 23 of the pad 22 to rotate the water deflection head 21 in accordance with the pattern of the grooves 23 and simultaneously continues the wobble of the deflection head 21. The wobbling and rotating of the deflection head 21 produces a more evenly distributed pattern of irrigation water from the sprinkler head, when being fed by a low pressure central water supply conduit 11 of a central pivot irrigation system or the like. Once the irrigation water has been shut off, the wobbling deflection head 21 will remain at an angled position with the surface of the protrusion member or cone 35 resting against the fixed protrusion member 40 and thus at an angle to the water when the water is first emitted from the nozzle 32. The two cones are in contact only in the rest position and have a circle of rotation well outside the stationary cone so that there is no contact during rotation.

The wobble generating member 40 can be seen having spring clips 41 protruding from the bottom of the central support cylinders 42 so that the member can be rapidly removed if it becomes worn or damaged or needs to be replaced with a different wobble generating member of a different type as desired and to produce a different wobble by the interaction of protruding members 35 and 40. The entire sprinkler head 12 can be made of an injection molded polymer even though it should be clear that it can be made of any material desired without departing the spirit and scope of the invention.

Figure 5:
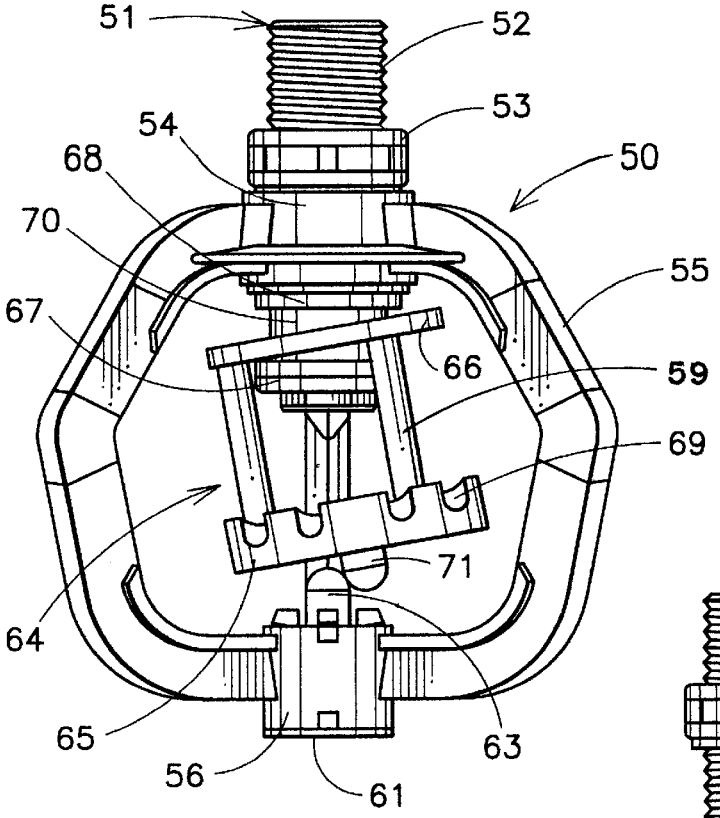
FIG. 5 is a side elevation of another embodiment of a sprinkler head in accordance with the present invention.
Figure 6:
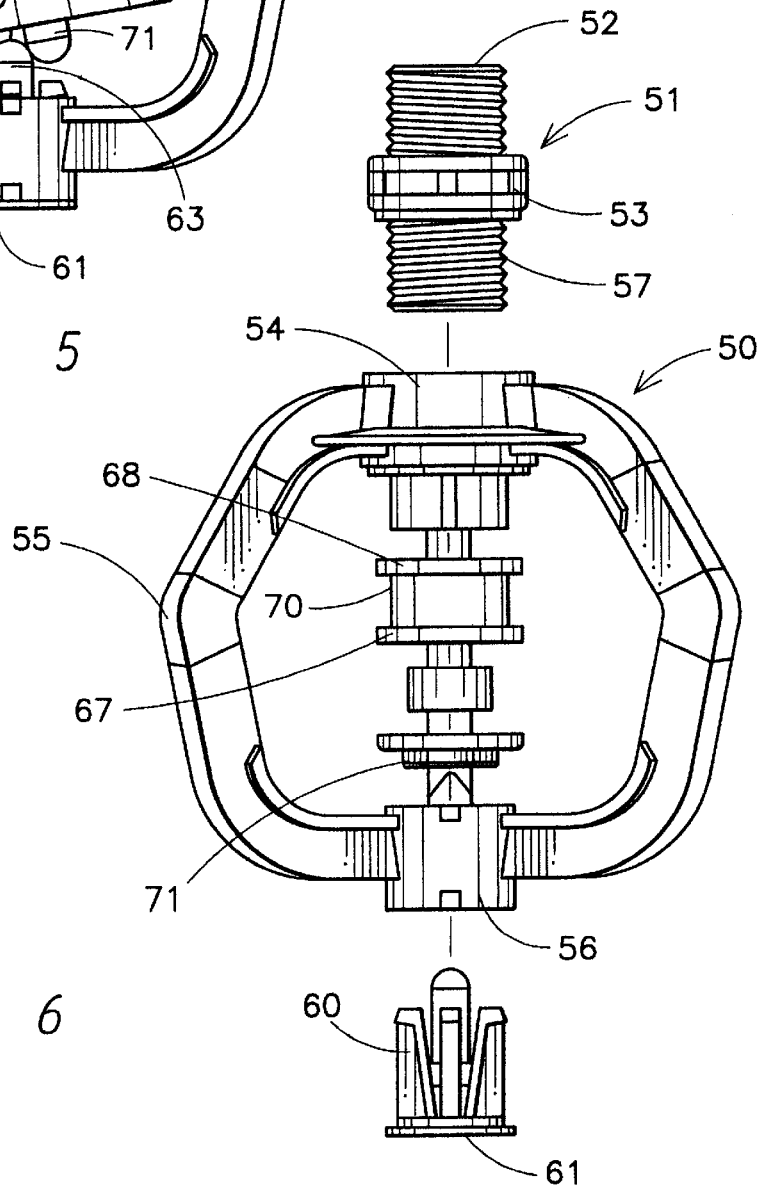
FIG. 6 is an exploded view of the sprinkler head of FIG. 5.

Referring now to FIGS. 5 and 6, an alternate embodiment of a sprinkler head 50 has a water supply line input 51 having a threaded surface 52 having a tool engaging surface 53 thereon. The sprinkler head 50 has a body 54 having three support arms 55 attached thereto supporting a support cylinder 56. The water input connection 51, as seen in FIG. 6, has external threads 57 on the opposite side of the wrench or tool engaging surface 53 and is threaded into the body portion 54. The hollow cylinder support member 56 can be seen having spring clips 60 attached to a base 61 for attaching to the cylinder 56 and supporting the wobble producing member 63 in position, as shown in FIG. 5. The wobble member 64 has a deflector pad 65 supported with the arms 59 from a support plate 66. The annular flange 67 supports the wobbling plate 66 thereon. Plate 66 is loosely supported between the annular flange 67 and a top flange 68 around a cylinder 70. The deflector plate 65 has a plurality of grooves 69 therein for deflecting the water in a direction to force rotation of the wobble plate 65. The bottom of the deflection plate 65 has a wobble producing member 71 similar to the wobble producing member 63, each having a rounded tip. The wobble producing member 71 rides against the wobble producing member 63 to force the wobble member 64 to always be positioned at a tilt so that the rotation of the deflection member 65 will rotate and wobble the wobble member 64. As seen in FIG. 6, a bolt member 72 locks the wobble member supporting flange 67 and 68 to the base member 54.

In operation, the water enters the water line input 51 and is directed against the wobble member 64 and against a water deflecting surface 65. The water is deflected through the channels 69 to force the wobble generating member 64 to rotate. Since the wobble generating member 64 is always maintained at a tilt by the protruding wobble producing members 63 and 71, the water deflection forces the wobble member 64 to wobble as it rotates to thereby provide a better sprinkler pattern to the water being disbursed in a downwardly extending sprinkler head from an irrigation water line. The sprinkler head is self-draining and always maintains itself in a position to begin wobbling as soon as the water is turned on to produce a stream of water.

It should be clear at this time that the present invention illustrates a wobbling irrigation sprinkler head which can advantageously be attached upside down or extend downward from a self-propelled irrigation water line and which is self-draining and always maintains itself in a position to begin wobbling as soon as the water is turned on to produce a stream of water from the nozzle 32 onto the deflection pad 22 or 65. The protruding members 35 and 40 can also contain permanent magnets 46 and 47 attached thereto positioned with facing magnet fields having opposite polarity. However, the present invention should not be construed as limited to the forms shown which are to be considered illustrative rather than restrictive.

We claim:

1. A wobbling sprinkler head comprising:

a sprinkler head body attachable to a water supply and having a water inlet and a nozzle for directing water from said water inlet, said sprinkler head body having at least one arm extending therefrom;

a water deflecting head movably attached to said sprinkler head body and having a water deflecting surface positioned to deflect water being emitted from said nozzle, said water deflecting surface having a predetermined shape to cause movement of said water deflecting head responsive to water being directed thereagainst, said water deflecting head having a first protruding wobble generating member extending therefrom; and a second protruding wobble generating member extending from said body arm adjacent said water deflecting head and positioned to one side of said water deflecting head first protruding wobble generating member to tilt said first protruding wobble generating member and water deflecting head to one side to thereby cause said water deflecting head to wobble responsive to water directed thereagainst from said body nozzle, whereby said water deflecting head has a wobbling motion while distributing water from said sprinkler head.

2. A wobbling sprinkler head in accordance with claim 1 in which said first protruding wobble generating member is a generally cone shaped member.

3. A wobbling sprinkler head in accordance with claim 2 in which said second protruding wobble generating member is a generally cone shaped member positioned for said first protruding generally cone shaped member to move therearound.

4. A wobbling sprinkler head in accordance with claim 3 in which said sprinkler head body has two arms extending around a portion of said water deflection head.

5. A wobbling sprinkler head in accordance with claim 4 in which said water deflection head water deflecting surface is a grooved deflector head pad.

6. A wobbling sprinkler head in accordance with claim 5 in which grooved deflector head pad has grooved channels arcuately formed therein and shaped to rotate said deflector head when water is impinged thereagainst.

7. A wobbling sprinkler head in accordance with claim 6 in which said nozzle has a deflector head supporting flange thereon supporting said water deflecting head.

8. A wobbling sprinkler head in accordance with claim 7 in which said water deflector head has a supporting base having an opening therein sized to be supported by said nozzle deflector head supporting flange.

9. A wobbling sprinkler head in accordance with claim 8 in which water deflecting head base has a plurality of posts extending therefrom, said posts having said water deflector pad attached thereto and positioned below said nozzle.

10. A wobbling sprinkler head in accordance with claim 2 in which said second protruding wobble generating member has a generally rounded end positioned for said first protruding member to move therearound.

11. A wobbling sprinkler head in accordance with claim 1 in which said first protruding wobble generating member has a generally rounded end.

12. A wobbling sprinkler head comprising:

a sprinkler head body attachable to a water supply and having a water inlet and a nozzle for directing water from said water inlet, said sprinkler head body having a plurality of arms extending therefrom;

a water deflecting head movably attached to said sprinkler head body and having a water deflecting surface positioned to deflect water being emitted from said nozzle, said water deflecting surface having a predetermined shape to cause movement of said water deflecting head responsive to water being directed thereagainst, said water deflecting head having a first protruding wobble generating member extending therefrom; and a removable base member removable attached to said plurality of arms and having a second protruding wobble generating member extending therefrom and positioned to one side of said water deflecting head first protruding wobble generating member to tilt said first protruding wobble generating member and water deflecting head to one side to thereby cause said water deflecting head to wobble responsive to water directed thereagainst from said body nozzle, whereby said water deflecting head has a wobbling motion while distributing water from said sprinkler head.

13. A wobbling sprinkler head in accordance with claim 12 in which said first protruding wobble generating member has a generally rounded shaped end portion.

14. A wobbling sprinkler head in accordance with claim 13 in which said second protruding wobble generating member has a generally rounded shaped end member positioned for said first protruding member to move therearound.

15. A wobbling sprinkler head in accordance with claim 12 in which said sprinkler head body plurality of arms includes three arms.

16. A wobbling sprinkler head in accordance with claim 12 in which said water deflection head water deflecting surface is a grooved deflector head pad.

17. A wobbling sprinkler head in accordance with claim 16 in which grooved deflector head pad has grooved channels arcuately formed therein and shaped to rotate said deflector head when water is impinged thereagainst.

18. A wobbling sprinkler head in accordance with claim 17 in which said nozzle has a deflector head supporting flange thereon supporting said water deflecting head.

* * * * *